US010428670B2

(12) United States Patent
Rioux

(10) Patent No.: US 10,428,670 B2
(45) Date of Patent: Oct. 1, 2019

(54) INGESTION SEAL

(71) Applicant: United Technologies Corporation, Farmington, CT (US)

(72) Inventor: Philip Robert Rioux, North Berwick, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 481 days.

(21) Appl. No.: 15/149,246

(22) Filed: May 9, 2016

(65) Prior Publication Data

US 2017/0321565 A1 Nov. 9, 2017

(51) Int. Cl.
*F01D 11/00* (2006.01)
*F01D 11/02* (2006.01)

(52) U.S. Cl.
CPC ..... *F01D 11/001* (2013.01); *F01D 11/02* (2013.01); *F05D 2220/32* (2013.01)

(58) Field of Classification Search
CPC ..... F01D 11/001; F01D 9/02; F01D 9/041; F01D 11/02
USPC ..... 415/173.5, 174.5, 173.7
See application file for complete search history.

(56) References Cited

U.S. PATENT DOCUMENTS 3,897,169 A * 7/1975 Fowler ..... F01D 5/225 277/419
4,335,886 A * 6/1982 Frey ..... F16J 15/4472 277/412
4,662,820 A * 5/1987 Sasada ..... F04D 29/161 415/173.6
5,429,478 A * 7/1995 Krizan ..... F01D 11/001 415/115
6,276,692 B1 * 8/2001 Beeck ..... F01D 11/04 277/411
7,430,802 B2 * 10/2008 Tiemann ..... F01D 5/3015 29/889.22
8,075,256 B2 * 12/2011 Little ..... F01D 11/001 415/173.1

(Continued)

FOREIGN PATENT DOCUMENTS

EP 2687682 A2 1/2014
EP 3203023 A1 8/2017

OTHER PUBLICATIONS

European Search Report Issued in EP Application No. 17170106.3, dated Oct. 9, 2017, 11 Pages.

(Continued)

*Primary Examiner* — Richard A Edgar
*Assistant Examiner* — Topaz L. Elliott
(74) *Attorney, Agent, or Firm* — Cantor Colburn LLP

(57) ABSTRACT

An arrangement of a rotating component and a stationary component of a gas turbine engine includes a rotating component, a stationary component positioned to define an actual gap between the rotating component and the stationary component, and a flow restriction feature formed at one of the stationary component or the rotating component. The flow restriction feature is configured to induce a recirculation flow at the actual gap, thereby defining an effective gap between the rotating component and the stationary component to reduce a leakage flow therebetween, while maintaining the actual gap greater than the effective gap.

17 Claims, 3 Drawing Sheets

(56) References Cited

U.S. PATENT DOCUMENTS

| | | | | |
|---|---|---|---|---|
| 8,262,342 | B2 * | 9/2012 | Morris | F01D 5/145 415/115 |
| 9,309,783 | B2 * | 4/2016 | Nallam | F01D 11/02 |
| 9,360,216 | B2 * | 6/2016 | Hase | F01D 5/143 |
| 9,476,315 | B2 * | 10/2016 | Shibata | F01D 11/08 |
| 2010/0008760 | A1 | 1/2010 | Morris et al. | |
| 2013/0224014 | A1 * | 8/2013 | Aggarwala | F01D 5/143 415/220 |
| 2013/0294897 | A1 | 11/2013 | Grover | |
| 2014/0020392 | A1 * | 1/2014 | Hase | F01D 5/143 60/735 |
| 2014/0119901 | A1 * | 5/2014 | Shibata | F01D 11/08 415/173.1 |
| 2015/0354391 | A1 * | 12/2015 | Li | F01D 11/001 415/173.1 |
| 2016/0123169 | A1 * | 5/2016 | Ruggiero | F01D 25/12 415/173.7 |

OTHER PUBLICATIONS

European Office Action Issued in EP Application No. 17 170 106.3; dated Oct. 8, 2018, 7 Pages.

* cited by examiner

INGESTION SEAL

BACKGROUND

This disclosure relates to gas turbine engines, and more particularly to the prevention of undesirable leakage between rotating components and stationary components of gas turbine engines.

Ingestion leakage between rotating structures and stationary or static structures of a gas turbine engine are challenging to overcome. If significant amounts of hot gas leak from the flow path of the gas turbine engine to areas outside of the flow path, not only is engine performance degraded, but components outside of the flowpath, which are not constructed to withstand such high temperatures, may be damaged by the hot gas leakage.

Typical configurations often include shiplap features, in which the static component and rotating component overlap radially and/or axially in an effort to prevent leakage. Such configurations, however, have limited success due to clearance gaps required between the static components and rotating components to prevent contact therebetween during operation of the gas turbine engine.

SUMMARY

In one embodiment, an arrangement of a rotating component and a stationary component of a gas turbine engine includes a rotating component, a stationary component positioned to define an actual gap between the rotating component and the stationary component, and a flow restriction feature formed at one of the stationary component or the rotating component. The flow restriction feature is configured to induce a recirculation flow at the actual gap, thereby defining an effective gap between the rotating component and the stationary component to reduce a leakage flow therebetween, while maintaining the actual gap greater than the effective gap.

Additionally or alternatively, in this or other embodiments the flow restriction feature is a hook feature formed in the stationary component.

Additionally or alternatively, in this or other embodiments the hook feature is located at an entrance to the actual gap at a hot gas flowpath of the gas turbine engine.

Additionally or alternatively, in this or other embodiments the flow restriction feature has a major axis extending substantially parallel to an airflow direction into the flow restriction feature.

Additionally or alternatively, in this or other embodiments one or more dividing walls are located at the flow restriction feature.

Additionally or alternatively, in this or other embodiments the one or more dividing walls are configured to restrict circumferential flow through the flow restriction feature.

In another embodiment, a turbine assembly of a gas turbine engine includes a turbine rotor rotatable about a central axis of the gas turbine engine, a turbine stator located axially adjacent to the turbine rotor defining an actual gap between the turbine rotor and the turbine stator. The turbine stator is configured to be stationary relative to the central axis. A flow restriction feature is formed at the turbine configured to induce a recirculation flow at the actual gap, thereby defining an effective gap between the turbine rotor and the turbine stator to reduce a leakage flow therebetween, while maintaining the actual gap greater than the effective gap.

Additionally or alternatively, in this or other embodiments the flow restriction feature is a hook feature formed in the stationary component.

Additionally or alternatively, in this or other embodiments the hook feature is located at an entrance to the actual gap at a hot gas flowpath of the gas turbine engine.

Additionally or alternatively, in this or other embodiments the flow restriction feature has a major axis extending substantially parallel to an airflow direction into the flow restriction feature.

Additionally or alternatively, in this or other embodiments one or more dividing walls are located at the flow restriction feature.

Additionally or alternatively, in this or other embodiments the one or more dividing walls are configured to restrict circumferential flow through the flow restriction feature.

In yet another embodiment, a gas turbine engine includes a rotating component, a stationary component positioned to define an actual gap between the rotating component and the stationary component and a flow restriction feature formed at one of the stationary component or the rotating component. The flow restriction feature is configured to induce a recirculation flow at the actual gap, thereby defining an effective gap between the rotating component and the stationary component to reduce a leakage flow therebetween, while maintaining the actual gap greater than the effective gap.

Additionally or alternatively, in this or other embodiments the flow restriction feature is a hook feature formed in the stationary component.

Additionally or alternatively, in this or other embodiments the hook feature is positioned at an entrance to the actual gap at a hot gas flowpath of the gas turbine engine.

Additionally or alternatively, in this or other embodiments the flow restriction feature has a major axis extending substantially parallel to an airflow direction into the flow restriction feature.

Additionally or alternatively, in this or other embodiments one or more dividing walls are located at the flow restriction feature.

Additionally or alternatively, in this or other embodiments the one or more dividing walls are configured to restrict circumferential flow through the flow restriction feature.

Additionally or alternatively, in this or other embodiments the rotating component is a turbine rotor.

Additionally or alternatively, in this or other embodiments the stationary component is a turbine stator.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
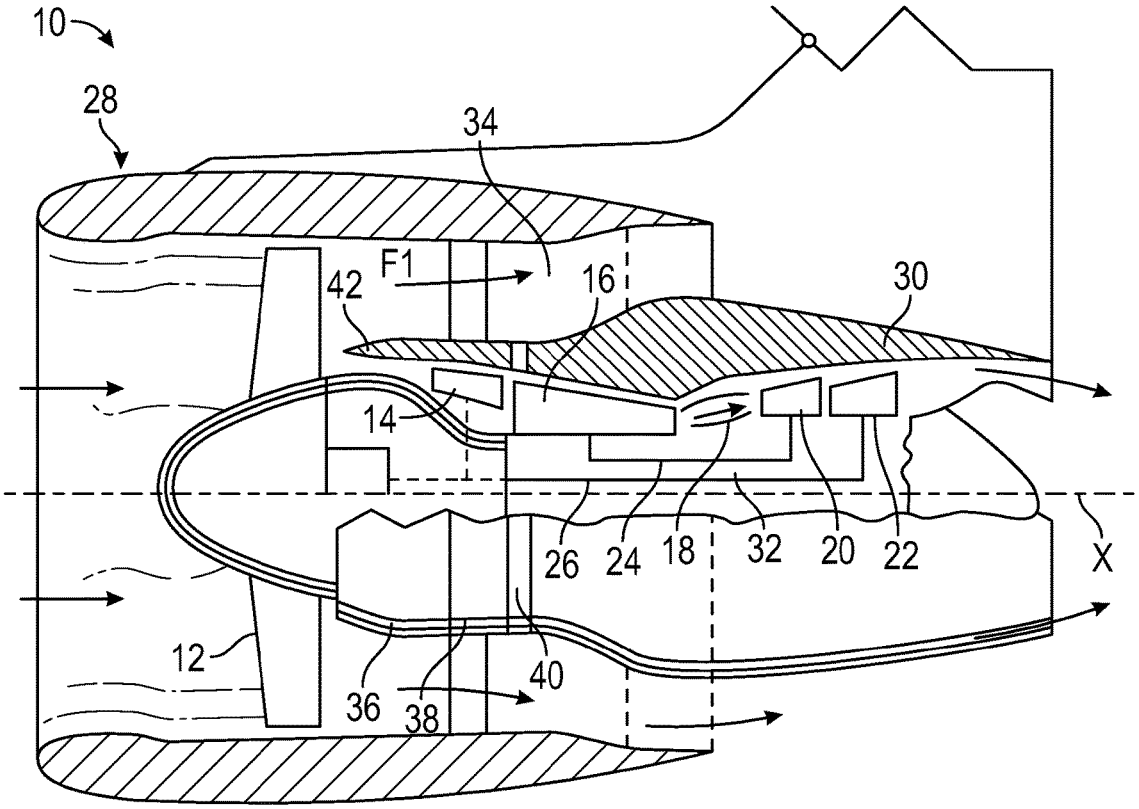
FIG. 1 illustrates a schematic cross-sectional view of an embodiment of a gas turbine engine.

FIG. 1 is a schematic illustration of a gas turbine engine 10. The gas turbine engine generally has includes fan section 12, a low pressure compressor 14, a high pressure compressor 16, a combustor 18, a high pressure turbine 20 and a low pressure turbine 22. The gas turbine engine 10 is circumferentially disposed about an engine centerline X. During operation, air is pulled into the gas turbine engine 10 by the fan section 12, pressurized by the compressors 14, 16, mixed with fuel and burned in the combustor 18. Hot combustion gases generated within the combustor 18 flow through high and low pressure turbines 20, 22, which extract energy from the hot combustion gases.

In a two-spool configuration, the high pressure turbine 20 utilizes the extracted energy from the hot combustion gases to power the high pressure compressor 16 through a high speed shaft 24, and the low pressure turbine 22 utilizes the energy extracted from the hot combustion gases to power the low pressure compressor 14 and the fan section 12 through a low speed shaft 26. The present disclosure, however, is not limited to the two-spool configuration described and may be utilized with other configurations, such as single-spool or three-spool configurations, or gear-driven fan configurations.

Gas turbine engine 10 is in the form of a high bypass ratio turbine engine mounted within a nacelle or fan casing 28 which surrounds an engine casing 30 housing an engine core 32. A significant amount of air pressurized by the fan section 12 bypasses the engine core 32 for the generation of propulsive thrust. The airflow entering the fan section 12 may bypass the engine core 32 via a fan bypass passage 34 extending between the fan casing 28 and the engine casing 30 for receiving and communicating a discharge flow F1. The high bypass flow arrangement provides a significant amount of thrust for powering an aircraft.

The engine casing 30 generally includes an inlet case 36, a low pressure compressor case 38, and an intermediate case 40. The inlet case 36 guides air to the low pressure compressor case 38, and via a splitter 42 also directs air through the fan bypass passage 34.

Figure 2:
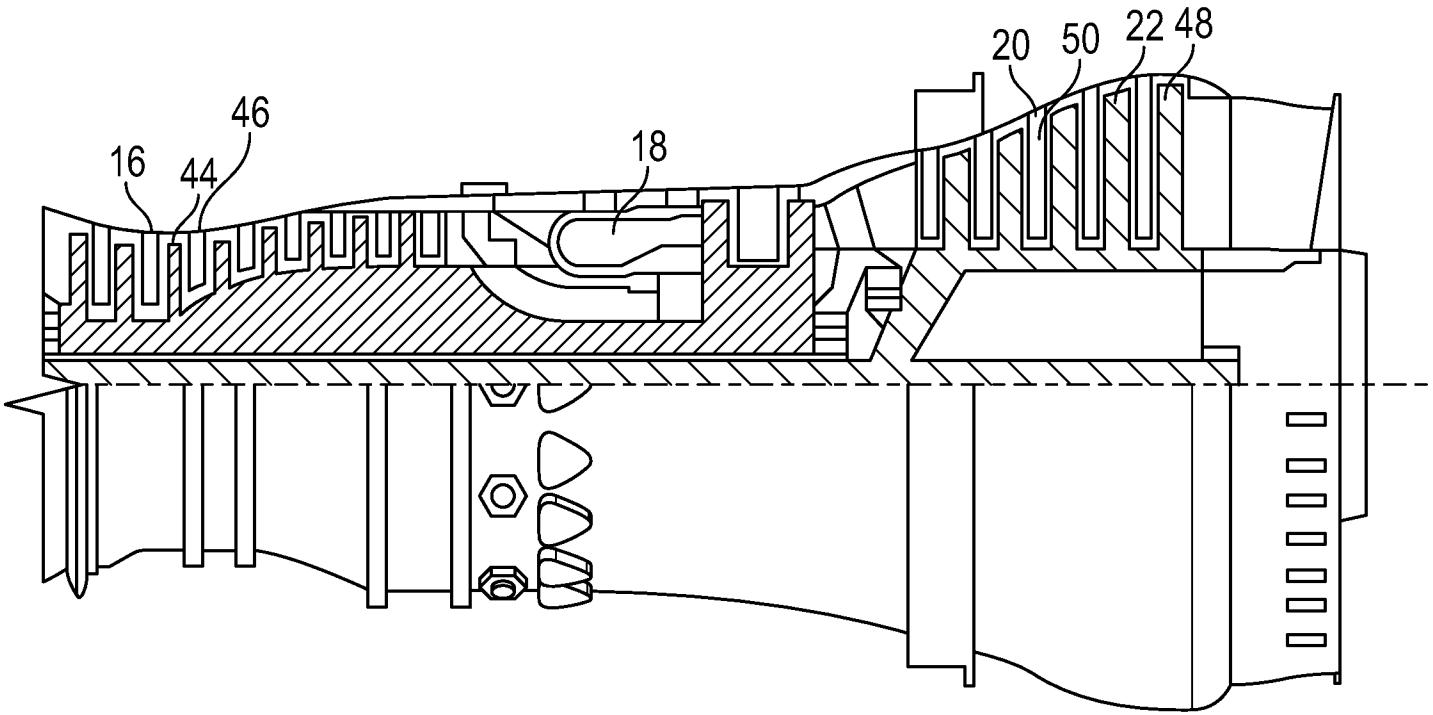
FIG. 2 illustrates a cross-sectional view of another embodiment of a gas turbine engine.

Referring now to FIG. 2, the high pressure compressor 16 includes one or more compressor rotors 44 rotatable about engine centerline X in an axially alternating arrangement with one or more compressor stators 46, which are rotationally stationary. Similarly, the high pressure turbine 20 and low pressure turbine 22 each include one or more turbine rotors 48 rotatable about engine centerline X in an axially alternating arrangement with one or more turbine stators 50, which are rotationally stationary.

Figure 3:
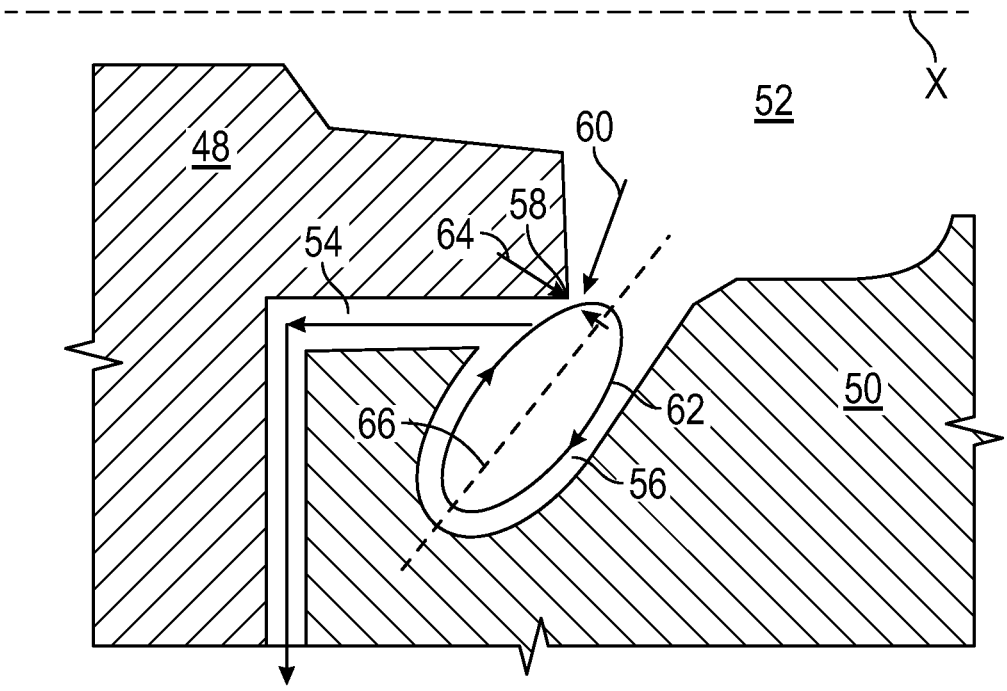
FIG. 3 illustrates a cross-sectional view of an interface between a rotating component and a stationary component of a gas turbine engine.

Referring now to FIG. 3, context of the following description is a high pressure turbine 20 with a turbine rotor 48 and a turbine stator 50, but one skilled in the art will readily appreciate that the present disclosure may be readily applied to other interface of rotating components with stationary components, such as compressor rotors 44 and compressor stators 46 or the like. FIG. 3 illustrates an interface of a turbine rotor 48 and a turbine stator 50 at a hot gas flowpath 52 of the gas turbine engine 10. The interface is configured with a gap 54, in this embodiment both radial and axial, between the turbine rotor 48 and the turbine stator 50 to prevent contact between the turbine rotor 48 and the turbine stator 50 during operation of the gas turbine engine 10. This gap 54, however, can often result in leakage flow from the hot gas flowpath 52 through the gap 54, which can reduce performance of the gas turbine engine 10 and even cause damage to components not configured to withstand temperatures of leakage from the hot gas flowpath 52. Further, the gap 54 can result in leakage flow from outside of the hot gas flowpath 52 through the gap 54 into the hot gas flowpath 52.

To prevent such leakage through the gap 54 either into or out of the hot gas flowpath 52, the turbine stator 50 includes a hook feature 56. In some embodiments, such as shown in FIG. 3, the hook feature 56 is a recess or notch formed in the turbine stator 50. The hook feature 56 may be located at a gap entrance 58 of the gap 54 at the hot gas flowpath 52 as shown in FIG. 3, or in other embodiments may be located at other locations along the gap 54 between the turbine rotor 48 and the turbine stator 50. The hook feature 56 extends at least partially around a circumference of the hot gas flow path 52, relative to the engine centerline X. In some embodiments, the hook feature 56 may extend continuously about the engine centerline X, while in other embodiments a plurality of hook features 56 may each extend partially about the engine centerline X. While in the embodiments described herein the hook features 56 are located at turbine stator 50, in other embodiments the hook features 56 may additionally or alternatively be located at the turbine rotor 48.

The hook feature 56 is configured to allow an airflow 60 from the hot gas flowpath 52 into the hook feature 56, which results in a recirculation flow 62 at least partially in the hook feature 56, and in some embodiments extending to outside of the hook feature 56. The recirculation flow 62 narrows an effective gap 64 between the turbine rotor 48 and the turbine stator 50 thus restricting airflow from the hot gas path 52 from flowing through the gap 54. In some embodiments, the hook feature 56 is curvilinear and has a major axis 66. The major axis 66 is substantially aligned with the airflow 60 to maximize the recirculation flow 62.

Figure 4:
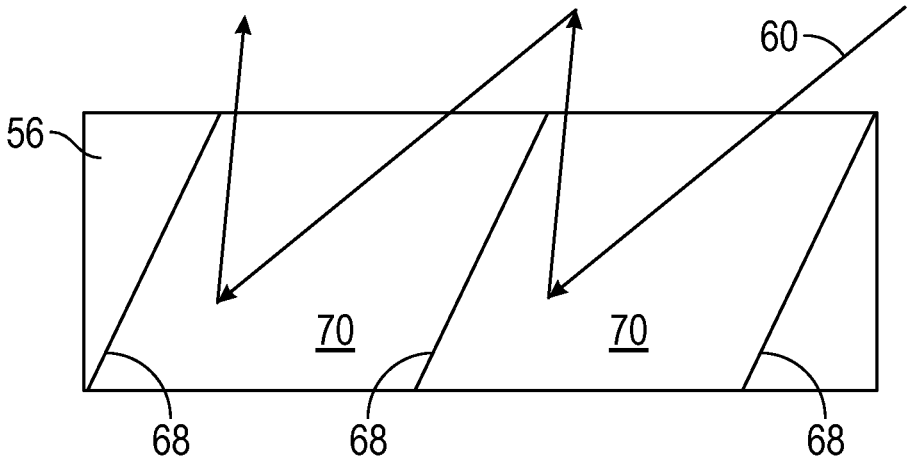
FIG. 4 illustrates another embodiment of an interface between a rotating component and a stationary component of a gas turbine engine.

Referring now to FIG. 4, in some embodiments one or more dividing walls 68 are located in the hook feature 56 to divide the hook feature 56 into a plurality of circumferential compartments 70. The circumferential pockets 70 are configured to prevent circumferential leakage flows.

Utilizing the hook feature 56 results in a non-contact flow restriction via the recirculation flow 60, which reduces the effective gap 62 between the turbine rotor 48 and the turbine stator 50. The recirculation flow 60 reduces leakage via reduction of the effective gap 62 while still allowing the actual gap 54 between the turbine rotor 48 and the turbine stator 50 to be large enough to provide adequate operational clearance so contact between the turbine rotor 48 and the turbine stator 50 is avoided during operation of the gas turbine engine.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. An arrangement of a rotating component and a stationary component of a gas turbine engine, comprising:

a rotating component;

a stationary component positioned to define an actual gap between the rotating component and the stationary component; and a flow restriction feature formed as a hook feature in the stationary component, the flow restriction feature configured to induce a recirculation flow at the actual gap, thereby defining an effective gap between the rotating component and the stationary component to reduce a leakage flow therebetween, while maintaining the actual gap greater than the effective gap;

wherein the actual gap is a radial gap defined between a first axially-extending surface of the rotating component and a second axially-extending surface of the stationary component, the second axially-extending surface disposed radially outboard of the first axially-extending surface, the first axially-extending surface terminating at a first corner, the second axially-extending surface and the flow restriction feature defining a second corner at the intersection thereof, the first corner extending axially into an area defined by the flow restriction feature, beyond the second corner;

wherein, in a direction of leakage flow from a hot gas path to the actual gap, the flow restriction feature is disposed between the hot gas path and the actual gap.

2. The arrangement of claim 1, wherein the hook feature is disposed at an entrance to the actual gap at a hot gas flowpath of the gas turbine engine.

3. The arrangement of claim 1, wherein the flow restriction feature has a major axis extending substantially parallel to an airflow direction into the flow restriction feature.

4. The arrangement of claim 1, further including one or more dividing walls disposed at the flow restriction feature.

5. The arrangement of claim 4, wherein the one or more dividing walls are configured to restrict circumferential flow through the flow restriction feature.

6. A turbine assembly of a gas turbine engine, comprising:

a turbine rotor rotatable about a central axis of the gas turbine engine;

a turbine stator located axially adjacent to the turbine rotor defining an actual gap between the turbine rotor and the turbine stator, the turbine stator configured to be stationary relative to the central axis; and a flow restriction feature formed as a hook feature in the turbine stator configured to induce a recirculation flow at the actual gap, thereby defining an effective gap between the turbine rotor and the turbine stator to reduce a leakage flow therebetween, while maintaining the actual gap greater than the effective gap;

wherein the actual gap is a radial gap defined between a first axially-extending surface of the turbine rotor and a second axially-extending surface of the turbine stator, the second axially-extending surface disposed radially outboard of the first axially-extending surface, the first axially-extending surface terminating at a first corner, the second axially-extending surface and the flow restriction feature defining a second corner at the intersection thereof, the first corner extending axially into an area defined by the flow restriction feature, beyond the second corner;

wherein, in a direction of leakage flow from a hot gas path to the actual gap, the flow restriction feature is disposed between the hot gas path and the actual gap.

7. The turbine assembly of claim 6, wherein the hook feature is disposed at an entrance to the actual gap at a hot gas flowpath of the gas turbine engine.

8. The turbine assembly of claim 6, wherein the flow restriction feature has a major axis extending substantially parallel to an airflow direction into the flow restriction feature.

9. The turbine assembly of claim 6, further including one or more dividing walls disposed at the flow restriction feature.

10. The turbine assembly of claim 9, wherein the one or more dividing walls are configured to restrict circumferential flow through the flow restriction feature.

11. A gas turbine engine, comprising:

a rotating component;

a stationary component positioned to define an actual gap between the rotating component and the stationary component; and a flow restriction feature formed as a hook feature in the stationary component , the flow restriction feature configured to induce a recirculation flow at the actual gap, thereby defining an effective gap between the rotating component and the stationary component to reduce a leakage flow therebetween, while maintaining the actual gap greater than the effective gap;

wherein the actual gap is a radial gap defined between a first axially-extending surface of the rotating component and a second axially-extending surface of the stationary component, the second axially-extending surface disposed radially outboard of the first axially-extending surface, the first axially extending surface terminating at a first corner, the second axially-extending surface and the flow restriction feature defining a second corner at the intersection thereof, the first corner extending axially into an area defined by the flow restriction feature, beyond the second corner;

wherein, in a direction of leakage flow from a hot gas path to the actual gap, the flow restriction feature is disposed between the hot gas path and the actual gap.

12. The gas turbine engine of claim 11, wherein the hook feature is disposed at an entrance to the actual gap at a hot gas flowpath of the gas turbine engine.

13. The gas turbine engine of claim 11, wherein the flow restriction feature has a major axis extending substantially parallel to an airflow direction into the flow restriction feature.

14. The gas turbine engine of claim 11, further including one or more dividing walls disposed at the flow restriction feature.

15. The gas turbine engine of claim 14, wherein the one or more dividing walls are configured to restrict circumferential flow through the flow restriction feature.

16. The gas turbine engine of claim 11, wherein the rotating component is a turbine rotor.

17. The gas turbine engine of claim 11, wherein the stationary component is a turbine stator.

* * * * *